US007025113B2

(12) United States Patent
Saha et al.

(10) Patent No.: US 7,025,113 B2
(45) Date of Patent: Apr. 11, 2006

(54) SEMI-SOLID CASTING PROCESS OF ALUMINUM ALLOYS WITH A GRAIN REFINER

(75) Inventors: Deepak Saha, Worcester, MA (US); Diran Apelian, West Boylston, MA (US); Mark A. Musser, Osceola, IN (US); Dayne Killingsworth, South Bend, IN (US); Zach Brown, Kalamazoo, MI (US)

(73) Assignee: SPX Corporation, Charlotte, NC (US)

( * ) Notice: Subject to any disclaimer, the term of this patent is extended or adjusted under 35 U.S.C. 154(b) by 41 days.

(21) Appl. No.: 10/622,775

(22) Filed: Jul. 21, 2003

(65) Prior Publication Data

US 2005/0016709 A1 Jan. 27, 2005

Related U.S. Application Data

(63) Continuation-in-part of application No. 10/426,799, filed on May 1, 2003, now Pat. No. 6,880,613.

(51) Int. Cl.
*B22D 17/10* (2006.01)

(52) U.S. Cl. ..... 164/113; 164/900

(58) Field of Classification Search ..... 164/113, 164/900, 312

See application file for complete search history.

(56) References Cited

U.S. PATENT DOCUMENTS 5,100,618 A 3/1992 Dewing et al. ..... 420/528
5,571,346 A * 11/1996 Bergsma ..... 148/550
5,846,350 A 12/1998 Bergsma ..... 148/549
5,911,843 A * 6/1999 Bergsma ..... 148/550
5,935,295 A 8/1999 Megy ..... 75/680
5,968,292 A * 10/1999 Bergsma ..... 148/437

FOREIGN PATENT DOCUMENTS

EP 0 554 808 8/1993

OTHER PUBLICATIONS

KB Alloys, Aluminum Grain Refiners, Apr. 28, 2003, p. 1.
KB Alloys, TIBOR Titanium Boron Aluminum Jun. 11, 2003, p. 1.
Aluminum Fact Sheet, In-Situ Grain Refinement Process for Aluminum, Apr. 2001.
Geoffrey K. Sigworth, Role of Alloy Composition in Grain Refining, pp. 1-9.
G. Wan, et al., "Thixoforming Of Aluminum Alloys Using Modified Chemical Grain Refinement For Billet Product" Associazione Italiana Di Metallurgia, Paizzale Rudolfo Morandi, 2, Milano, Italy 1993. Conference: International Conference On Aluminium Alloys: New Process Technologies, Marina Di Ravenna, Italy, Jun. 3-4, 1993, 129-141 XP009037979.

(Continued)

*Primary Examiner*—Len Tran
(74) *Attorney, Agent, or Firm*—Baker & Hostetler LLP

(57) ABSTRACT

A method for the refining of primary aluminum in hypoeutectic alloys by mixing a titanium based grain refiner into a solid/semi-solid hypoeutectic slurry is described. The method provides control of the morphology, size, and distribution of primary Al in a hypoeutectic Al—Si casting by mixing a hypoeutectic Al—Si liquid with titanium boron alloys. The invention enables grain refining techniques for SSM casting of hypoeutectic Al—Si alloys.

23 Claims, 3 Drawing Sheets

OTHER PUBLICATIONS

Rachmat, R.S., et al., "Application of Semi-solid forming to 2024 and 7075 Wrought Aluminum Billets Fabricated by The EMC Process" Material Schience Forum 329-330, 487-492, Photomicrographs, Graphs, Numerical Data 7 Ref. Switzerland Conference: Solidification and gravity 2000, Miskolc, Hungary, Apri 25-28, 1999 ISSN: 0255-5476, 2000 XP009037970.

Zhang, X.-D. (Reynolds Metals) et al.: "Development of Non-Dendritic, Microstructures In AA6061 Cast Billets." Materials Science Forum 331-337, (1), 247-252, Graphs, Photomicrographs, 11 ref. Switzerland Conference: Aluminium Alloys: Their Physical and Mechanical Properties (ICaa7), Charlottesville, Virginia, USA Apr. 9-14, 2000 ISSN: 0255-5476, 2000, XP009037968.

Tahara, K., et al.: "Semi—Solid Solidification Structure in Grain—refined A17%Si-3%Cu Alloy." Alluminium Alloys: Their Physical And Mechanical Properties, 303-308, Photomicrographs, Graphs, 8 Ref. Japan Institute of Light Metals. Tsukamoto Sozan Bldg., 6F, 4-2-15 Ginza, Chuo-Ku, Tokyo, 104-0061, Japan Conference: ICAA-6: 6th International Co, 1998, XP009037987.

* cited by examiner

Edge

Picture Taken at 100X

Picture Taken at 100X

Center

SEMI-SOLID CASTING PROCESS OF ALUMINUM ALLOYS WITH A GRAIN REFINER

PRIORITY

This application claims priority to and is a continuation-in-part of U.S. patent application entitled, Semi-Solid Metal Casting Process of Hypoeutectic Aluminum Alloys, filed May 1, 2003, having Ser. No. 10/426,799 now U.S. Pat. No. 6,880,613, the disclosure of which is hereby incorporated by reference.

FIELD OF THE INVENTION

The present invention relates generally to casting aluminum-silicon metal alloys. More particularly, the present invention relates to semi-solid metal casting of hypoeutectic aluminum-silicon alloys using titanium alloy grain refiners.

BACKGROUND OF THE INVENTION

Conventional casting methods such as die casting, gravity permanent mold casting, and squeeze casting have long been used for Aluminum-Silicon (Al—Si) alloys. However, where semi-solid metal (SSM) casting of Al—Si alloy materials has been involved, the conventional methods have not been employed successfully to date. Rheocasting and thixocasting are casting methods that were developed in an attempt to convert conventional casting means to SSM casting. However, these SSM methods require costly retrofitting to conventional casting machinery.

Challenges also remain in the ability to manipulate the mechanical and metallurgical properties of SSM castings. As the performance of the cast product is predicated, in part, by the microstructures of primary Al and/or Si particles in the part, attempts have been made to improve methods to achieve the requisite microstructure. One approach is to achieve homogeneous distribution of primary Al or Si, while another is to limit the growth and size of the particles themselves.

The physical characteristics of the primary particles depends on the imposed temperature gradient, presence of impurities, and ease of nucleation. Known strategies to affect these parameters include the use of electromagnetic stirring and grain refiners, such as titanium alloys. Alternatively, control of the cooling rate and isothermal hold time of the alloy at the SSM temperature can also affect the microstructures. Most, if not all, of the research in this regard has been, however, related to conventional casting of Al—Si alloys and little has been employed in SSM casting of Al—Si alloys.

Accordingly, it is desirable to provide a method of casting SSM Al—Si alloys utilizing both conventional and rheocasting means that can impart desirable mechanical properties. In particular, there is a need for controlling the nucleation of primary Al particles in Al—Si alloys to limit the formation of large primary Al particles.

SUMMARY OF THE INVENTION

The foregoing needs are met, to a great extent, by the present invention, wherein in one embodiment a method is provided for using titanium alloys as grain refiners in SSM casting. In some embodiments the titanium alloy may be a titanium boron alloy.

In accordance with another embodiment of the present invention at least one Al—Si hypoeutectic alloy or titanium alloy is heated, the Al—Si hypoeutectic alloy is then mixed with the titanium alloy, the hypoeutectic alloy-titanium alloy mixture is cooled for a length of time to form a semi-solid metal, and then the semi-solid metal is cast. In some embodiments both the Al—Si hypoeutectic alloy and the titanium alloy are heated. The titanium alloy may be a titanium boron alloy and preferably the TIBOR® alloy. The amount of the titanium boron alloy to be added is chosen to achieve a finer Al particle size as compared to casting the Al—Si hypoeutectic alloy without addition of the titanium boron alloy. Generally, the amount of titanium boron alloy is chosen to achieve a cast product having Al particles with an average diameter ranging from about 40 microns to about 60 microns, and preferably also chosen to achieve a cast product with Al particles that are more uniformly dispersed than a cast product made by a conventional SSM rheocasting process without the addition of a titanium boron alloy. The hypoeutectic Al—Si alloy may be less than about 11.7 percent by weight Si, and more preferably, about 6 to about 8 percent Si by weight. The hypoeutectic alloy may also be a 357 alloy.

In accordance with another embodiment of the present invention, an SSM cast product that is manufactured by an SSM casting process using a titanium alloy is provided. The titanium alloy can be a titanium boron alloy and preferably, the TIBOR® alloy.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
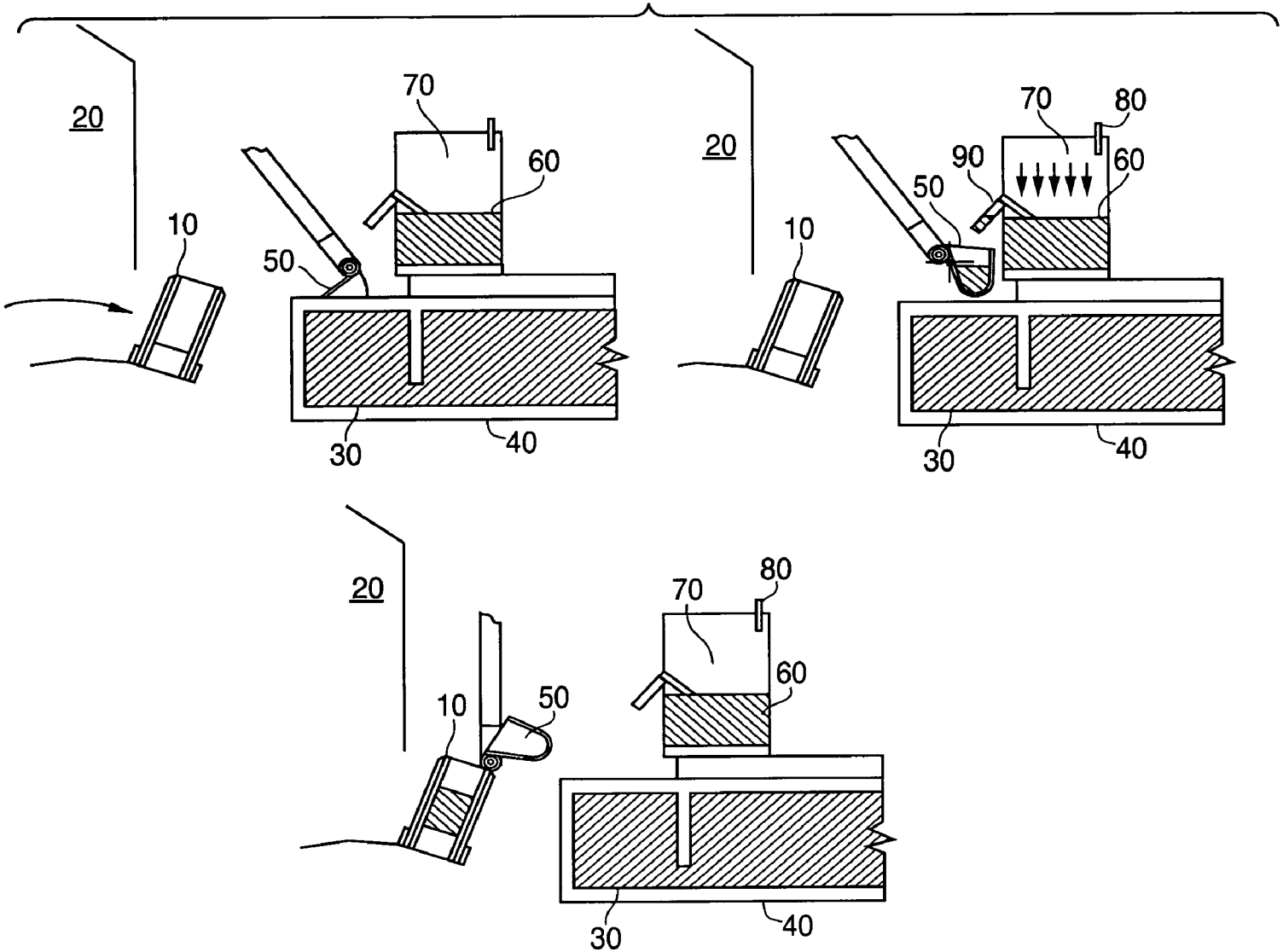
FIG. 1 is a graphic representation of one embodiment of how the inventive process can be performed.

The invention will now be described with reference to the drawing figures. An embodiment in accordance with the present invention enables a method for controlling the composition and microstructure of Al—Si alloys prior to SSM casting in an attempt to control the mechanical properties of the final cast product. Generally, this is accomplished by mixing a hypoeutectic Al—Si alloy with a grain refiner. By definition, aluminum alloys with up to but less than about 11.7 weight percent Si are defined "hypoeutectic", whereas those alloys with greater than about 11.7 weight percent Si are defined "hypereutectic". In all instances, the term "about" has been incorporated in this disclosure to account for the inherent inaccuracies associated with measuring chemical weights and measurements known and present in the art. Aluminum alloys of this invention are defined to also include varying purities of aluminum.

In one embodiment of the invention, a body of molten aluminum is grain refined by providing in the body a controlled level of a titanium alloy which forms small, discrete titanium compounds such as $TiB_2$ that provide nucleation sites for grain refining aluminum. It will also be appreciated that in order for the titanium to function as a refiner, a material or compound, which first reacts with the titanium and/or the aluminum to form a titanium based grain refiner nuclei, is required. For purposes of the invention, so called reducible binary or titanium reactive materials may be added separately to the melt or can be included with the titanium as in the form of a metal alloy.

Titanium reactive materials suitable for grain refining in combination with titanium include compounds which provide at least one of the following elements: boron, carbon, sulfur, phosphorus and nitrogen in the molten aluminum. It should be understood that any compound or material may be used which provides an element, which in combination with titanium, operates to provide grain refining nuclei. As noted, however, it is preferred that titanium be introduced in the form of an alloy, which includes the titanium reactive material.

Referring now to FIG. 1, a squeeze casting process in accordance with one embodiment of the invention is illustrated. Persons of ordinary skill in the art will recognize that alternate embodiments are also possible within the scope and spirit of the present invention, and that therefore, the invention should not be limited to the details of the construction or the arrangement of the components described herein.

According to the embodiment in FIG. 1, a shot sleeve 10 on a casting device 20 first reaches a pour position thereupon initiating a pour cycle. The shot sleeve 10 is a receptacle to contain measured amounts of liquid/slurry material to be later transferred into a die cavity within the casting device 20. Molten metal of hypoeutectic Al—Si alloy 30 is ladled from a holding furnace 40 using a ladle 50. The metal is preferably heated to greater than the liquidus temperature, and with hypoeutectic Al—Si alloys, the temperature is preferably greater than about 617° C. Higher temperatures can also be used.

The ladle 50 then next moves into position to receive the titanium alloy 60. Multiple titanium alloys are known and present in the art and may be used in a manner described herein. Even though the invention has been described particularly with respect to titanium alloys, it will be appreciated that other metals are contemplated within the scope of the invention, including but not limited to niobium, tantalum, vanadium, molybdenum, zirconium and beryllium. In some embodiments, the titanium boron (TiB) alloy is preferable.

Once the ladle 50 is in the receiving position, a dosing furnace 70 is pressurized through an inlet 80 with preferably compressed air. Any gas, and preferably inert gas, can also be operational. The amount of pressure can be calibrated to accurately and consistently dose substantially equal amounts of the titanium alloy 60. Regardless, with adequate pressure, the titanium alloy 60 is ejected through a spout 90 and into the ladle 50, thereby mixing the titanium alloy 60 with the molten alloy 30. Alternatively, the combined alloys 30 and 60 may be mechanically stirred to adequately mix the alloys.

The ladle 50 is then moved into position over the shot sleeve 10. The contents are poured into the shot sleeve 10 which may optionally be preheated to just above the liquidus temperature of the alloy 30. Once the combined alloys 30 and 60 are cooled to the SSM range, the slurry is then injected by any one of a variety of methods known in the art into the die cavity and proceeds to be cast.

Without being held to or limited by theory, the refining of the aluminum is generally thought to be instantaneous in the art, but longer times may be necessary. It is better, however, to minimize the time between casting the molten aluminum 30 and adding the titanium alloy 60. That is, if the titanium alloy 60 is added earlier, it may permit some settling of the titanium particles to occur. Thus, for purposes of the present invention, to minimize settling (sometimes referred to as fade) of the titanium alloy 60, it is preferred to add the titanium alloy 60 as near the casting time as possible.

Additionally, the growth of Al particles in the semi-solid phase can be directly correlated to the initial temperature and the time of cooling of the alloy before casting. The longer an alloy remains in the semi-solid phase, the likelihood for undesirable growth of large Al particles is increased. Alternatively, shortening the time an alloy spends in the SSM phase before casting minimizes the growth of large Al particles by maximizing the number of nucleating events, producing more Al particles of smaller size.

In some embodiments, the titanium grain refiner, such as TiB, can be added to the molten Al—Si alloy as a metal alloy and preferably, an aluminum metal alloy. TIBOR® is an TiB—Al alloy commercially available from KB Alloys, Inc. located in Reading, Pa. The TIBOR® master alloy supplies titanium in many ratios with boron. In some embodiments, the Ti:B ratio is 5:1 as in TIBOR® Alloy Product No. H2252. No matter the vehicle, the titanium alloy is heated to a liquid state. Generally, the TIBOR® alloy is heated to a range from about 600° C. to about 700° C. and preferably from about 612° C. to about 630° C. in some embodiments.

It should be noted that the titanium alloy 60 can be added anywhere in the process as long as it is added concurrently or prior to casting. Preferably, the titanium alloy 60 is added to the molten alloy 30 as shown in FIG. 1 though the metal alloys may be combined in the alternate order as well. The amount of titanium added should be sufficient to provide for grain refining of the aluminum body. The amount of titanium in the master alloys used for grain refining generally range from about 1 to about 10 percent Ti by weight, with a preferred amount ranging from about 2 to about 5 percent Ti by weight and typically an amount ranging from about 3 to about 5 percent Ti by weight. Higher amounts of titanium can be used but care is required to avoid exceeding the solubility limit of titanium in molten aluminum or the formation of substantial amounts of titanium aluminide particles in the melt. Titanium aluminide forms large particles which are detrimental in processing or working the cast product.

In the present invention, the amount of titanium refiner material added is important. That is, it is preferred to add the titanium material or compound at a level below its solubility limit in molten aluminum. If the solubility limit of the titanium in molten aluminum is exceeded, then undesirable compound or precipitates form. Further, it is preferred that the titanium concentration is maintained stoichiometrically in excess of the reactive material or compound in the molten aluminum body. Thus, the molar ratio of titanium to reactive material in the melt is maintained such that there is an excess of titanium present in the active nuclei being formed. The concentration and ratio depends to some extent on the titanium reactive material used and can be experimentally determined. In some embodiments, the amount of titanium in the final part will be less than about 1% Ti by weight. In other embodiments the amount of titanium in the final part will range from about 0.2% to about 0.5%

Figure 2:
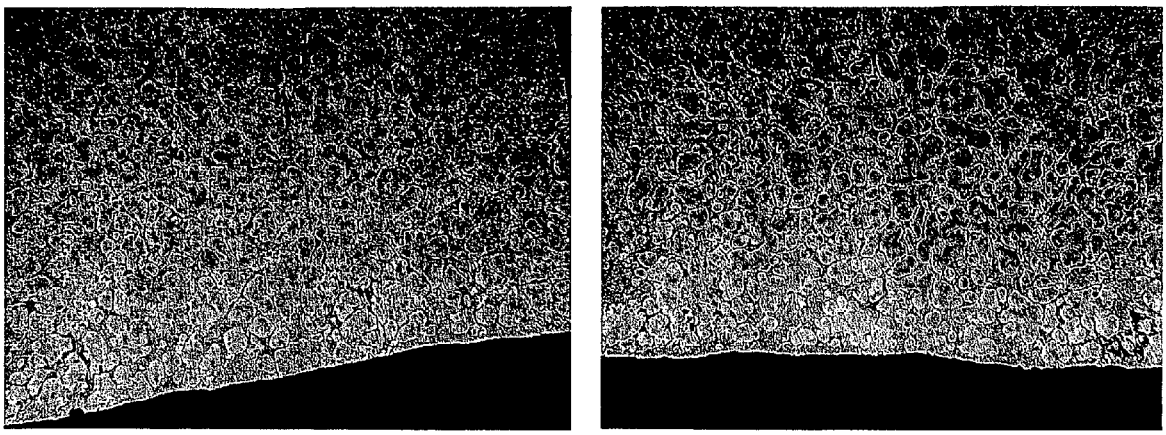
FIG. 2 shows the representative microstructure from the edge of a casting produced by the process of FIG. 1.

FIG. 2 is representative of the microstructure of products cast by the inventive steps described after they have been quenched. In the particular embodiment presented, liquid aluminum titanium-boron alloy was heated to 1135° C. and combined with a 357 alloy (commercially available alloy of approximately 7% Si) also heated to 1135° C. The combined liquid mixture was fed into a shot sleeve and cast. In this particular embodiment, the amount of TIBOR® addition was calculated to target metal chemistry in the final mix to have 0.25%–0.30% titanium by weight. It will also be appreciated that when using TiB alloys with Al or Si, the percentage of Al or Si will have to be taken into consideration in determining final concentration of the representative elements.

Two separate cross sections of the cast product were taken from the edge and center. Microanalysis of the various sections of the casting demonstrates that the primary Al particles are relatively evenly distributed with minimal aggregate formation. The Al particles are seen as the light colored particles in the microstructure, and the darker background is the eutectic (i.e., a mixture of Al—Si). The Al particles shown range in size from about 40 microns to about 60 microns in diameter from the center of the cast though to the edge of the cast. These results are comparable to the final parts obtained in thixocasting which are prepared to contain Al particles of desirable size and distribution.

Analysis of the edge cross sections of FIG. 2 shows the morphology of primary Al to be less uniform and slightly radiating from a given point (star-shaped). This is generally observed at the outer edges of a casting where the molten liquid or slurry comes in direct contact with the cold surface of the die cast. A more rapid drop in temperature results in greater nucleating events than if the temperature is dropped gradually as is seen in other parts of the cast. This has the desirable effect of generating multiple Al particles that are smaller in size (width and length), but also may lead to lack of uniform distributed through out the edges of the cast alloy.

Figure 3:
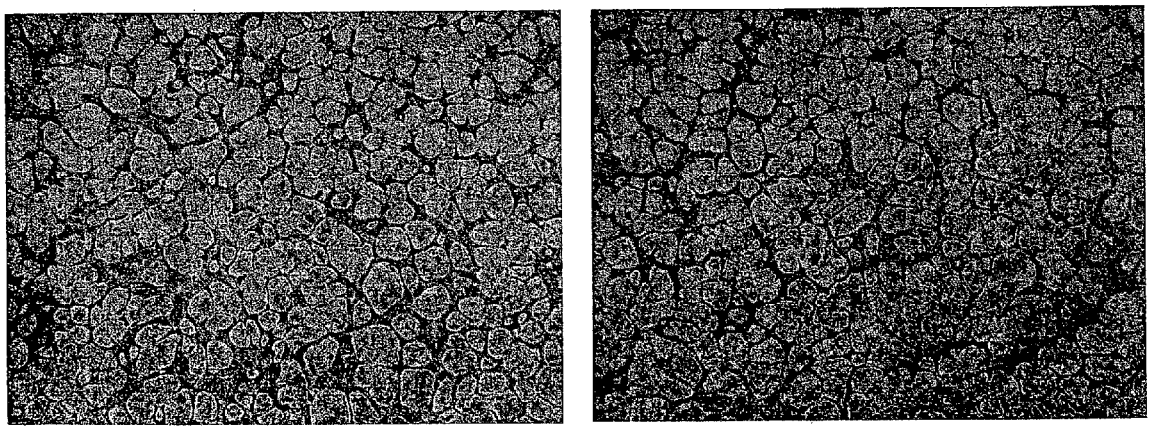
FIG. 3 shows the representative microstructure from the center of a castings produced by the process of FIG. 1.

The presence of the grain refiner provides greater nucleating events than in its absence. This has the desirable effect of generating multiple Al particles that are smaller in size (width and length), but also generally uniformly distributed through out the alloy. The even distribution of the Al particles from the center of the cast product, as best seen in FIG. 3, allows for better prediction of mechanical properties with less likelihood of mechanical failure which in effect limit the average growth of the Al particles and diminished the likelihood of globular aggregates. Therefore, preferable characteristics of SSM cast alloys can be attained by controlling the temperatures of the solutions and the addition of grain refiners during casting. With regard to controlling the temperature, the difference in temperature between the Al—Si hypoeutectic alloy and the TiB—Al alloy may be chosen to achieve a determined rate of cooling which may allow control of primary Al particle size in the final cast product. That is. by mixing a predetermined amount of a relatively low temperature Al—Si hypoeutectic alloy at about 600° C. to about 700° C. with a predetermined amount of a relatively high temperature TiB—Al alloy at about 1135° C., a rapid, controlled, and reproducible temperature drop in the TiB—Al alloy is achieved. As discussed herein, this rapid temperature drop generally results in greater nucleating events than if the temperature is dropped gradually. In this manner, a cast product is generated having a more favorable grain structure than cast products utilizing conventional techniques.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A rheocasting method for semi-solid metal casting, comprising:

providing a first alloy, the first alloy including an aluminum-silicon hypoeutectic alloy;

providing a second alloy, the second alloy including a grain refiner;

providing a reactive material;

liquefying at least one of the first alloy and the second alloy by heating to a first temperature;

combining the reactive material and the second alloy to form a mixture;

combining the first alloy and the mixture to form a combination;

generating a semi-solid metal by cooling the combination to a second temperature, wherein the semi-solid metal includes a multitude of aluminum particles having a particle size and a particle number;

injecting the semi-solid metal into a die cavity to form a cast product; and controlling the particle size and the particle number by modulating the second temperature and an elapse time between the generation of the semi-solid metal and the injection.

2. The method of claim 1, wherein the particle size is minimized by reducing the elapse time.

3. The method of claim 1, wherein the particle number is maximized by reducing the elapse time.

4. The method of claim 1, wherein the elapse time is reduced by combining the first alloy with the second alloy, the first alloy having a relatively lower temperature than the second alloy.

5. The method of claim 1, wherein the second alloy comprises at least one of titanium, niobium, tantalum, vanadium, molybdenum, zirconium, and beryllium.

6. The method of claim 1, wherein the reactive material comprises at least one of aluminum, boron, carbon, sulfur, phosphorus, and nitrogen.

7. The method of claim 1, wherein the cast product comprises aluminum particles having an average diameter of less than about 70 microns.

8. The method of claim 7, wherein the cast product comprises aluminum particles having an average diameter from about 40 microns to about 60 microns.

9. The method of claim 1, further comprising heating both the first alloy and the second alloy.

10. The method of claim 1, wherein the first temperature is greater than about 617° C.

11. The method of claim 10, wherein the first temperature is about 1135° C.

12. The method of claim 1, wherein the first temperature is about 600° C. to about 700° C.

13. The method of claim 12, wherein the first temperature is about 612° C. to about 630° C.

14. The method of claim 1, wherein the first temperature is about 1135° C.

15. The method of claim 1, wherein the first alloy comprises about less than 11.7% silicon.

16. The method of claim 15, wherein the first alloy comprises about 6% to about 8% silicon.

17. The method of claim 16, wherein the first alloy comprises about 7% silicon.

18. The method of claim 1, wherein the second alloy comprise about 1% to about 10% titanium.

19. The method of claim 18, wherein the second alloy comprises about 2% to about 5% titanium.

20. The method of claim 19, wherein the second alloy comprises about 3% to about 5% titanium.

21. The method of claim 1, wherein the cast product comprises about less than 1% titanium.

22. The method of claim 1, wherein the cast product comprises about 0.2% to about 0.5% titanium.

23. The method of claim 22, wherein the cast product comprises about 0.25% to about 0.3% titanium.

* * * * *